US006736348B1

(12) United States Patent
Formon et al.

(10) Patent No.: US 6,736,348 B1
(45) Date of Patent: May 18, 2004

(54) POWER TRANSFER SYSTEM APPARATUS

(75) Inventors: John S. Formon, Orange Park, FL (US); James H. Murphy, St. Augustine, FL (US); Andrew Morris, Green Cove Springs, FL (US); Paul Dowd, Bronxville, NY (US); Will Isaksson, New York, NY (US)

(73) Assignee: Georgia-Pacific Corporation, Atlanta, GA (US)

( * ) Notice: Subject to any disclaimer, the term of this patent is extended or adjusted under 35 U.S.C. 154(b) by 356 days.

(21) Appl. No.: 09/604,811

(22) Filed: Jun. 28, 2000

(51) Int. Cl.[7] ..... B65H 19/10; B65H 20/00; B65H 43/02

(52) U.S. Cl. ..... 242/560.1; 242/559.4; 242/563; 242/564.4

(58) Field of Search ..... 242/564.4, 560, 242/563, 560.1, 559.4

(56) References Cited

U.S. PATENT DOCUMENTS

| | | | | | |
|---|---|---|---|---|---|
| 3,288,387 | A | | 11/1966 | Craven, Jr. | |
| 3,635,417 | A | * | 1/1972 | Kajiwara et al. | 242/78.8 |
| 3,850,356 | A | * | 11/1974 | Abe et al. | 226/110 |
| 3,917,191 | A | | 11/1975 | Graham, Jr. et al. | |
| 4,106,684 | A | | 8/1978 | Hartbauer et al. | |
| 4,148,442 | A | * | 4/1979 | Baumann et al. | 242/55.3 |
| 4,159,807 | A | * | 7/1979 | Honsel et al. | 242/57 |
| 4,165,138 | A | | 8/1979 | Hedge et al. | |
| 4,378,912 | A | | 4/1983 | Perrin et al. | |
| 4,611,768 | A | | 9/1986 | Voss et al. | |
| 5,294,192 | A | | 3/1994 | Omdoll et al. | |
| 5,299,407 | A | * | 4/1994 | Schuttler et al. | 53/399 |
| 5,400,982 | A | * | 3/1995 | Collins | 242/560 |
| 5,511,743 | A | * | 4/1996 | Kozlowsky et al. | 242/526 |
| 5,526,973 | A | | 6/1996 | Boone et al. | |
| 5,553,522 | A | * | 9/1996 | Boldrini et al. | 83/13 |
| 5,604,992 | A | * | 2/1997 | Robinson | 34/90 |
| 5,772,291 | A | * | 6/1998 | Byrd et al. | 612/34.22 |
| 5,806,203 | A | * | 9/1998 | Robinson | 34/90 |
| 5,823,083 | A | * | 10/1998 | Opertegger et al. | 83/175 |
| 5,833,413 | A | | 11/1998 | Cornelius | |
| 5,868,343 | A | | 2/1999 | Granger | |
| 5,899,406 | A | * | 5/1999 | Payne | 242/552 |
| 5,915,645 | A | | 6/1999 | Granger | |
| 5,974,764 | A | * | 11/1999 | Anstey et al. | 53/118 |
| 6,032,898 | A | * | 3/2000 | LaCount et al. | 242/564.2 |
| 6,145,779 | A | * | 11/2000 | Johnson et al. | 242/560.1 |
| 6,152,397 | A | * | 11/2000 | Purcell | 242/560.1 |
| 6,354,533 | B1 | * | 3/2002 | Jespersen | 242/560.1 |

* cited by examiner

*Primary Examiner*—Donald P. Walsh
*Assistant Examiner*—Daniel K Schlak
(74) *Attorney, Agent, or Firm*—Banner & Witcoff, Ltd.

(57) ABSTRACT

A paper towel dispenser which provides for hands free, automatic feeding of the first sheet of a primary web roll, such as a paper towel roll, into a feed mechanism when its cover is closed. The dispenser also automatically transfers its web feed supply from a primary roll to a reserve roll upon the exhaustion of the primary roll. The present invention eliminates the need for an attendant to thread the leading edge of a primary or reserve roll into the feed mechanism of the dispenser. The dispenser also eliminates wasted paper because it does not begin to feed the reserve roll until the primary roll has expired. The dispenser can include either a manual feed mechanism or a powered feed mechanism. The dispenser relies on a sensor for determining when a portion of the web is absent from a side of the feed mechanism proximate a web discharge opening. When such an absence is sensed, an automatic, powered web transfer mechanism contacts the web located in front of the feed mechanism and positions it between the rollers of the feed mechanism. The transfer mechanism includes a web transfer member and a motor for driving the transfer member in the direction of the feed mechanism. The dispenser also includes a retraction mechanism for returning the transfer bar to a rest position after the web has been introduced into the feed mechanism.

38 Claims, 3 Drawing Sheets

POWER TRANSFER SYSTEM APPARATUS

The present invention relates generally to a flexible web dispenser that includes a powered, hands-free web transfer mechanism and, more particularly, to a paper towel dispenser having a automatic, power transfer mechanism for introducing a primary towel roll into a towel feeding mechanism and for transferring the feed supply of a paper towel dispenser from a primary roll to a reserve roll upon the sensed exhaustion of the primary roll.

BACKGROUND OF THE INVENTION

Industrial dispensers are widely used in public lavatories for dispensing paper towels to users. These dispensers can be designed to dispense either rolled paper towel sheets or folded paper towels arranged in a linear bundle. Rolled paper towels are continuous webs of paper toweling that are wound around a central core and, upon dispensing, are separated into and delivered as individual lengths of material. Folded towels are individual lengths of a paper web that have been pre-cut, folded into a predetermined configuration and arranged in a vertical or horizontal bundle for being individually dispensed.

Rolled paper towel dispensers typically include a user operated crank or lever that drives a feed mechanism to dispense the paper towels. However, as can be appreciated, these dispensers can also include an automatically operated feed mechanism as disclosed in copending U.S. Pat. applications Ser. Nos. 09/081,637 and 09/453,794 to Formon et al. titled "Paper Towel Dispenser" which are hereby expressly incorporated by reference. The automatic feed mechanism includes a drive roller and a pressure roller, also known as a pinch roller, which form a nip. When the rolled paper runs out in a conventional roll dispenser, an attendant must replace the roll(s) and manually insert the leading edge of the rolled towel into the nip. This can require complex towel threading and complicated loading sequences. After the attendant has placed the leading edge of the roll into the nip, the feed mechanism is operated in order to advance the leading edge through the feed mechanism, unwind the paper towel from the roll core and deliver the paper towel to the user. The feed mechanism can be either manual or automatic.

In contrast to folded paper towel dispensers, there is no economical way to replenish a roll towel dispenser when only a portion of the reserve roll, or "stub" roll, remains within the dispenser. In some prior art dispensers, a new roll must be substituted for the stub roll, thereby wasting whatever paper remains on the stub. This can result in increased operational costs as a significant amount of paper maybe be wasted in facilities with many dispensers. To overcome the problem of stub roll waste, roll dispensers have been designed to dispense two rolls of web material sequentially such that upon depletion of a primary roll, feeding from a reserve roll is commenced.

Prior art systems have included different types of transfer systems to change between the primary and reserve rolls. One such transfer system uses the diameter of the primary roll as a gauge for activating a transfer mechanism when it reaches a predetermined size. U.S. Pat. No. 5,294,192 to Omdoll et al. discloses a system which includes a mechanical sensor that detects the amount of paper towel on a primary roll. When the primary roll is depleted to a predetermined level, the sensor mechanically activates a transfer apparatus which drives the free end of the reserve roll into the nip of a dispenser using a transfer bar. However, since the sensor detects the size of the primary roll, not the end of the rolled web, the reserve web may begin dispensing prior to the complete exhaustion of the primary roll. Thus, for a period of time, paper towel is simultaneously dispensed from both rolls. This results in wasted paper towels. Additionally, these types of mechanical sensors can become stuck within the dispenser and fail to operate.

To overcome these disadvantages, the systems of U.S. Pat. No. 4,165,138 to Hedge et al., U.S. Pat. No. 4,611,768 to Voss, et al., and U.S. Pat. No. 4,378,912 to Perrin et al. provide a transfer mechanism which is based on the feed rolls themselves. These systems utilize a transfer mechanism which senses the absence or presence of paper from around a feed roll. In one system, this is accomplished by a sensing finger which rides along the top surface of the web material and then drops down into a groove in the feed roll which is exposed when the trailing end of the primary web has been unwound from the roll. In response to the sensing finger moving into the groove, the reserve web is introduced into the feed nip between the drive roller and the pressure roller, and the dispenser begins to feed the reserve roll to the user. This type of transfer mechanism generally eliminates the false transfers associated with tension responsive systems and reduces the amount of double sheet dispensing which occurs in diameter sensing transfer systems. The use of sensing fingers on the web material, however, produces extra friction which can inadvertently tear the web. Moreover, the introduction of additional components to sense the absence of the web and transfer the reserve web to between the feed rollers creates opportunities for a transfer failure to occur.

The object of the present invention is to overcome the drawbacks of the prior art paper towel dispensers.

It is also an object of the present invention to provide a web dispenser that includes a powered web transfer mechanism which eliminates the need for an attendant to feed a leading edge of a rolled web into the nip.

It is further an object of the present invention to provide a web dispenser having a powered web transfer mechanism that automatically and reliably feeds a leading edge of a reserve roll into a nip.

SUMMARY OF THE INVENTION

The present invention relates to a paper towel dispenser which provides hands free, automatic feeding of the first sheet of a primary web roll, such as a paper towel roll, into a feed mechanism when its cover is closed. The dispenser also automatically transfers its web feed supply from a primary roll to a reserve roll upon the exhaustion of the primary roll. The present invention eliminates the need for an attendant to thread the leading edge of a primary or reserve roll into the feed mechanism of the dispenser. The dispenser also eliminates wasted paper because it does not begin to feed the reserve roll until the primary roll has expired.

The dispenser includes a chassis having a web discharge opening and a feed mechanism for advancing the web to the web discharge opening. The dispenser can include either a manual feed mechanism or a powered feed mechanism. The dispenser also includes a sensor for determining when a portion of the web is absent from a side of the feed mechanism proximate the web discharge opening. When such an absence is sensed, an automatic, powered web transfer mechanism contacts the web located in front of the feed mechanism and positions it between the rollers of the feed mechanism. The transfer mechanism includes a web transfer member and a motor for driving the transfer member in the direction of the feed mechanism. The dispenser also includes a retraction mechanism for returning the transfer bar to a rest position after the web has been introduced into the feed mechanism.

A method of positioning a web in a feed mechanism of a dispenser according to the present invention includes the steps of positioning a leading edge of a web proximate a first side of the feed mechanism, sensing the absence of the web on a second side of the feed mechanism and activating a powered transfer drive mechanism in response to the sensed absence. The method further includes the steps of automatically advancing a transfer bar in the direction of the feed mechanism when the drive mechanism is activated, engaging the web with a plurality of web positioning members on the transfer bar and advancing the web into the feed mechanism.

DETAILED DESCRIPTION OF THE INVENTION

Figure 1:
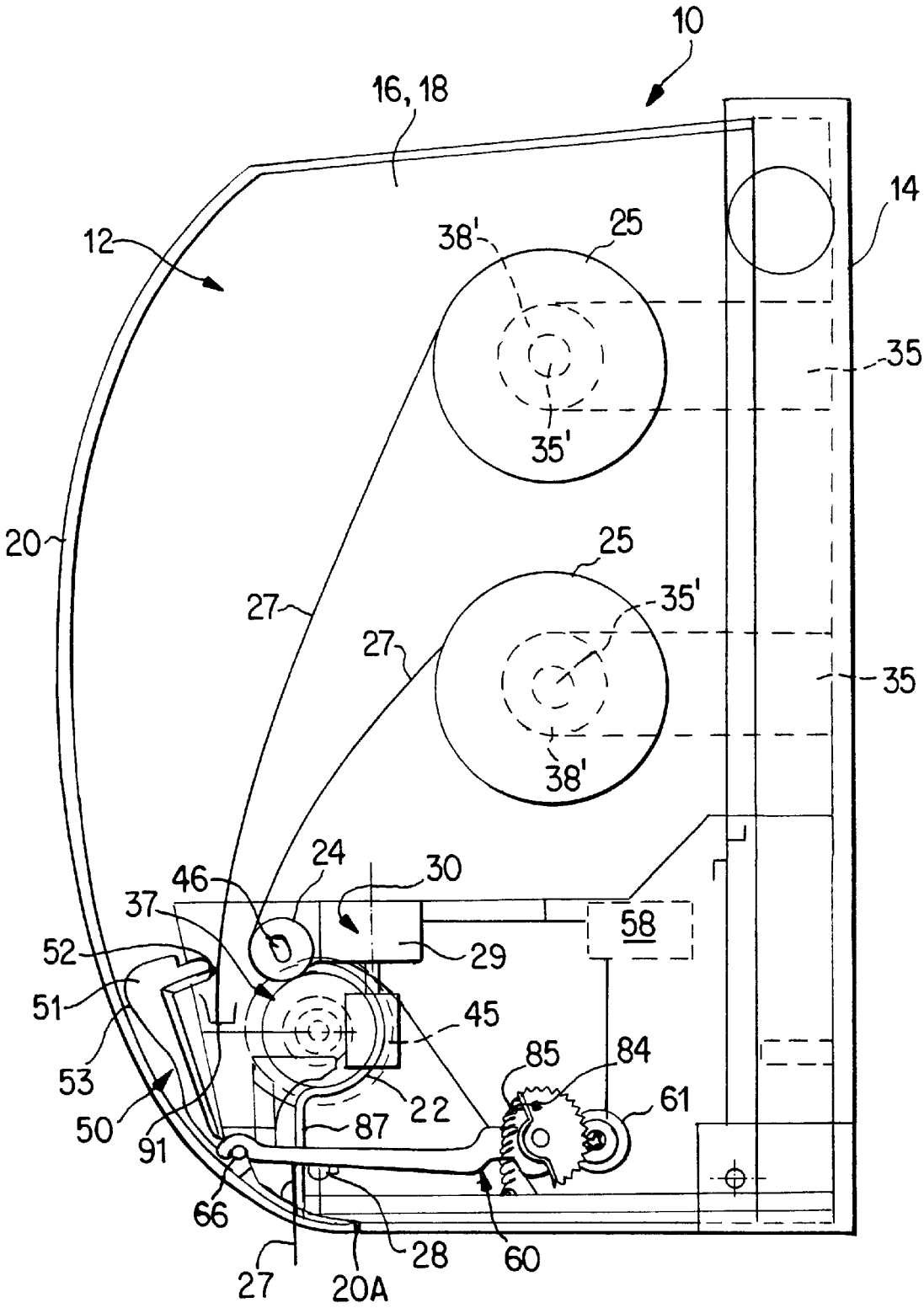
FIG. 1 is a side view of a dispenser according to the present invention.
Figure 2:
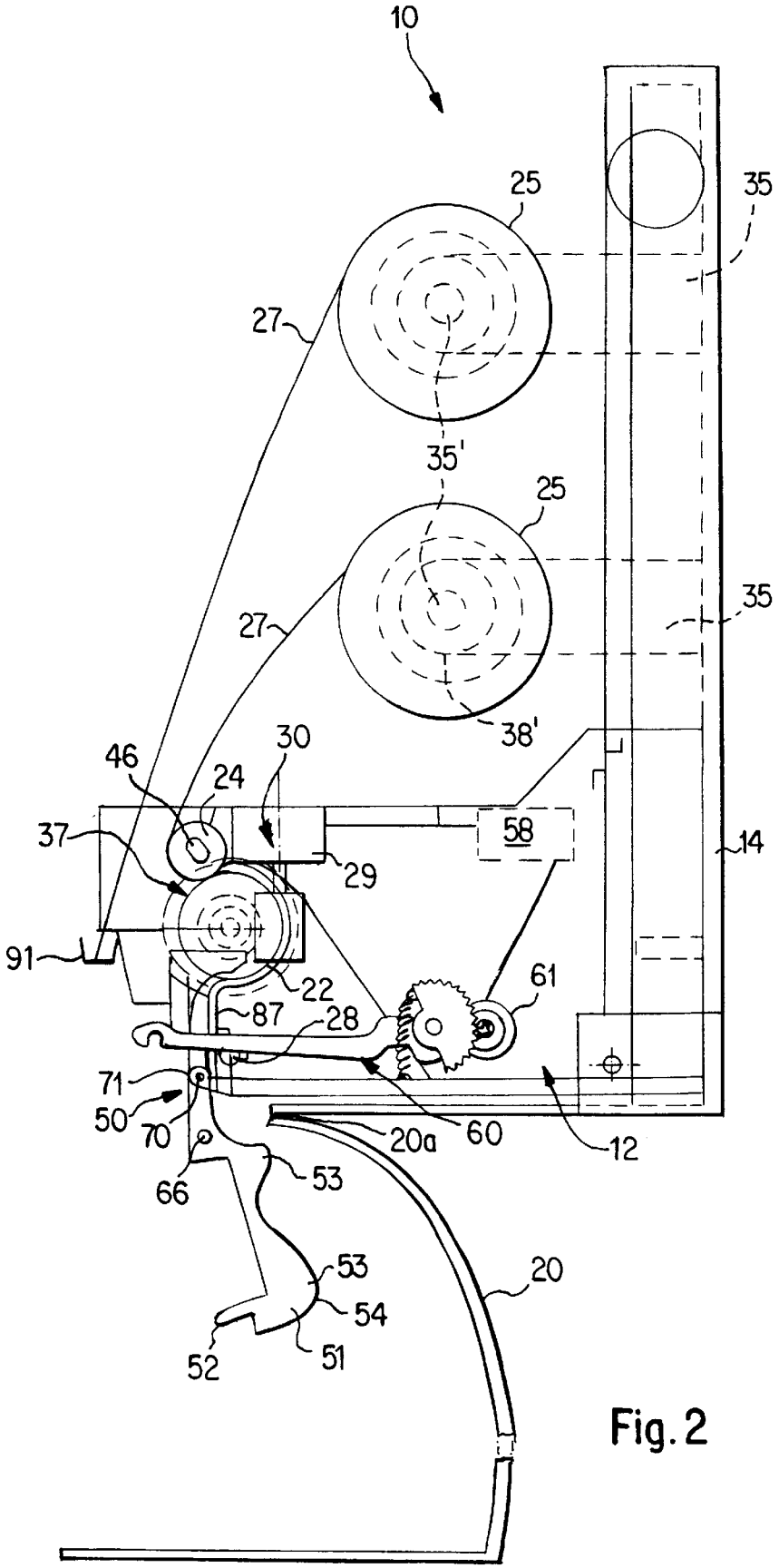
FIG. 2 is a side view of the dispenser with the cover and transfer bar in web loading positions.

FIGS. 1 and 2 illustrate a paper towel dispenser 10 according to the present invention comprising a chassis 12 which includes a back panel 14, side panels 16, and a pivotal front cover 20 attached by a pin, hinge or other convenient attachment mechanism 20*a*. Front cover 20 is opened and pivoted away from chassis 12 to a web loading position so that a primary roll 25 and a reserve roll 25 of a web 27 can be loaded into the dispenser 10. In a preferred embodiment, each roll consists of a continuous web 27 of a paper towel wound upon a hollow, cylindrical core 38'. However, the dispenser 10 could dispense other flexible webs. The web 27 can include flat or folded sheet segments. In the preferred embodiment, the web 27 includes a series of spaced apart, transverse tear lines which subdivide the web into the sheet segments of a predetermined length. Rolls 25 are rotatably supported by a pair of arms 35 extending forwardly from back panel 14. Each of the arms 35 includes an inwardly directed hub 35' loosely received within the core 38' of the rolls 25 to permit free rotation of the rolls 25. However, other mounting arrangements could also be used.

A feed mechanism 37 is mounted within the housing defined by chassis 12 to dispense the web 27 in incremental sheet segments. The feed mechanism 37 can be either manually operated using a lever or other well known devices, or it can be operated using an automatically activated motor as discussed in the copending U.S. patent applications to Formon et al. that were previously incorporated by reference. In the preferred construction, feed mechanism 37 includes a feed (drive) roller 22 and a pressure roller 24 which cooperate to dispense the web 27. Feed roller 22 and pressure roller 24 are mounted upon axles 45, 46, respectively, rotatably supported by side panels 16. The pressure roller 24 is preferably biased against the feed roller by a spring (not shown) to define a feed nip 47 for dispensing the web 27 through a discharge opening 48.

When the dispenser 10 includes a powered feed mechanism 37, the feed roller 22 is driven in a direction (i.e. clockwise as viewed in FIG. 1) by an electric motor 30 mounted within the dispenser and powered by batteries 58. A worm gear secured to a drive shaft of motor 30 engages a drive gear secured to axle 45 and rotates feed roller 22. When the paper web 27 is fed into the nip 47 as discussed below, the rotation of the feed roller 22 causes the web 27 to be advanced around feed roller 22, and out through discharge opening 48. A guide plate 87 is provided to direct the web 27 along the desired path. Low power requirements for motor 30 insure that the batteries 58 need only infrequent replacement. Other feed mechanisms having other roller and gear arrangements, or other power supplies, such as a step down AC to DC power supply, could also be used.

The web 27 is introduced into the feed mechanism 37 by power transfer system 50 which includes a transfer bar 51 pivotally mounted within the dispenser 10. The powered transfer system 50 also includes a transfer drive system 60 which operatively connects the transfer bar 51 to an electric transfer motor 61 located within the dispenser chassis 12. The drive system 60 imparts the rotary movement of the output shaft of the transfer motor 61 to the transfer bar 51 so that the transfer bar 51 and finger 52 rotate in the direction of the nip 47 and position the web 27 in the nip 47 when the motor 61 is operated. The electric motor 61 has low power requirements and, in a preferred embodiment, is powered by the same batteries 58 as electric motor 30. Alternatively, the transfer motor 61 can be powered by a dedicated DC power supply or a step down AC to DC power supply.

Figure 3:
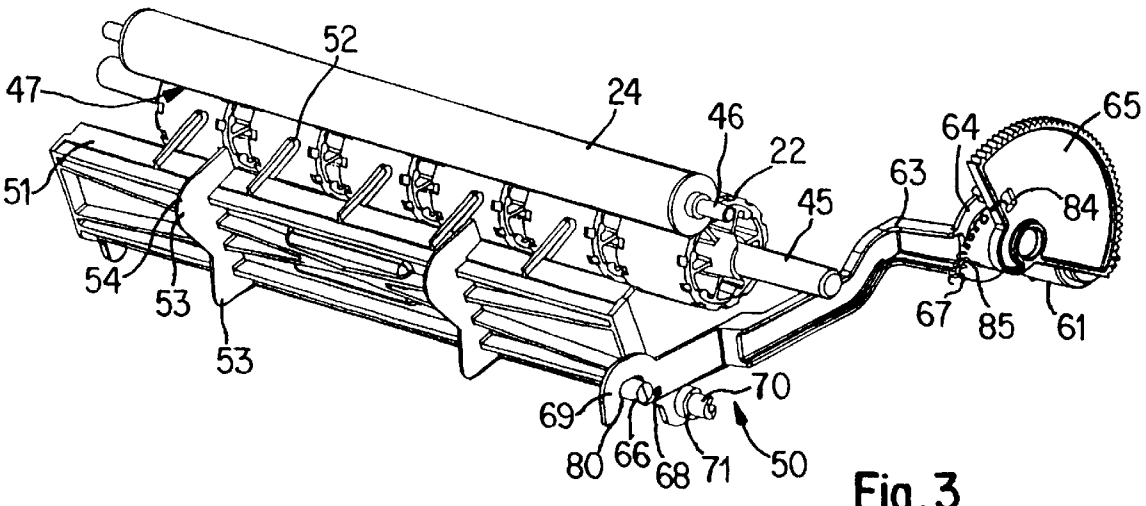
FIG. 3 is a perspective view of the transfer mechanism according to the present invention.

As shown in FIG. 3, transfer bar 51 is an elongated member having a plurality of cross braces that provide rigidity. The transfer bar 51 extends between the side panels 16 of the chassis 12 and along the length of the nip 47. It is contemplated that the nip 47 can extend a greater or lesser distance between the side panels 16 than the transfer bar 51. The transfer bar 51 also includes cover engaging members 53 with rounded upper shoulders 54 that rest against the inside of the front cover 20 when the cover 20 is closed and the transfer bar 51 is at rest. The cover engaging members 53 can include any shape that support the transfer bar 51 on the front cover 20.

A set of bearings 71 pivotally support the transfer bar 51 on a shaft 70 which extends between the side panels 16. These bearings 71 permit the transfer bar 51 to rotate in a direction (counter clockwise in FIG. 1) about the shaft 70 when the cover 20 is pivoted to an open position so that the transfer bar 51 and cover 20 can both rotate to a web loading position in which they are conveniently out of the way of the attendant loading the dispenser as shown in FIG. 2. The bearings 71 also permit the transfer bar to rotate about shaft 70 in the direction of the nip 47 (clockwise in FIG. 1) when the transfer mechanism 50 is activated, as discussed below. The transfer bar 51 can also be mounted to the chassis using hinges or other convenient attaching mechanisms which will allow it to pivot or move away from the nip so that the primary and/or secondary rolls of web 27 can be installed. In another preferred embodiment, the transfer bar 51 could experience both translational and arcuate movement when traveling from its rest position against cover 20 to its web loading position. The shaft 70 includes a groove 72 which engages an elongated member (not shown) secured within the dispenser. When engaged, the elongated member prevents the shaft 70 from translational motion when the transfer bar 51 rotates. Other well known ways of restraining (locking) the shaft 70 against translational motion can also be used.

Figure 4:
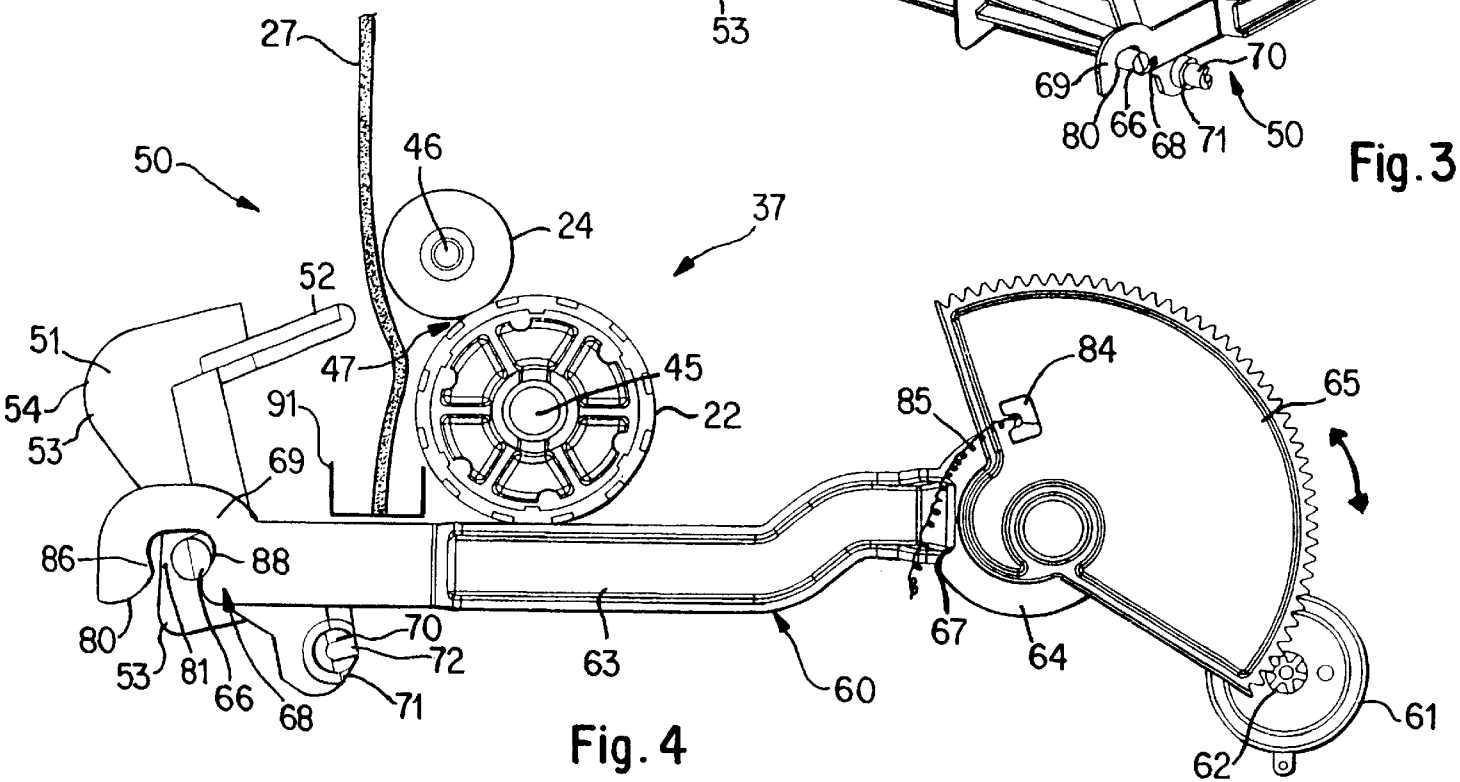
FIG. 4 is a side schematic view of the transfer mechanism and a portion of the feed mechanism according to the present invention.

The transfer bar 51 also includes a plurality of the rigid transfer fingers 52 spaced along its length for engaging the paper web 27 and positioning it in the nip 47 formed by the feed roller 22 and the pressure roller 24. FIGS. 3 and 4 show the transfer bar 51 including fingers 52. The number of transfer fingers 52 can depend on the length of the transfer bar 51 or the strength of the paper web. The longer the transfer bar 51 or the weaker the paper web 27, the more transfer fingers 52 that will be spaced along the transfer bar 51. As shown in FIG. 4, the fingers 52 extend away from the transfer bar in the direction of the nip 47. These fingers 52 include paper contacting ends 57 which have a rounded forward edge that is directed at the nip 47 when the transfer bar 51 is in its rest position. The forward edge of each finger 52 is rounded and sized so that it will engage and position the paper web 27 between the rollers 22, 24 without tearing it.

The motor 61 is activated by a sensor 28 located within the dispenser 10 for detecting the presence or absence of the web 27 at the discharge side of the feed mechanism 37. The sensor 28 is coupled with a microprocessor 29 or the like so that the motor 61 is activated immediately after the trailing edge of a roll 25 of the web 27 passes the sensor 28 or when no web 27 is sensed. The sensor 28 may be any suitable mechanism, for example, a limit switch (not shown), an acoustical sensor (not shown) or an optical sensor that includes an emitter and a photo diode that is occulated by the web 27. In the latter example, the emitter may be pulsed and the output of the photodiode high-pass filtered. In this way, the effect of ambient light on the photo diode is compensated. This may be implemented directly through the microprocessor 29.

The transfer drive system 60 includes an output gear 62 which is connected to the output shaft of the transfer motor 61 and a transfer gear 65 which meshes with the output gear 62 so that the transfer gear 65 will rotate when the transfer motor 61 is operated. As seen in FIG. 4, the transfer gear 65 forms a portion of a circle. A plurality of gear teeth are positioned along the outer circumference of transfer gear 65. These teeth mesh with the teeth of output gear 62 and drive the transfer gear 65 in a clockwise direction (as shown in FIG. 4) when the transfer motor 61 is operated. The gear teeth extend along the outer circumference of the transfer gear 65 which is equal to or greater than the length of the arc that the transfer bar 51 sweeps when it moves from its rest position to a web insertion position where it engages the web and introduces it into the nip 47. The distance the teeth extend along the transfer gear 65 can be changed to meet the needs of a particular dispenser, so long as they extend over a distance which is sufficient to move the transfer bar 51 between its rest position and its final, web insertion position.

A transfer link 63 extends between the transfer gear 65 and the transfer bar 51 for imparting the movement of the transfer gear 65 to the transfer bar 51. The transfer link 63 is formed of a rigid material, such as a plastic, so that the movement of the transfer gear 65 will be efficiently transferred to the transfer bar 51. The transfer link 63 is secured at a first end 67 to the transfer gear 65 by a linkage plate 64. As the transfer gear 65 is driven in a clockwise direction by output gear 62, as shown in FIG. 4, the linkage plate 64 is rotated and the transfer link 63 moves linearly and arcuately upwardly in the direction of the transfer gear 65. This is in part due to the position of link 63 on transfer gear 65. At a second end 68, the transfer link 63 includes an open bottom hook 69 that engages a post 66 extending outwardly from one side of the transfer bar 51 in the direction of one of the side panels 16. As the transfer link 63 moves linearly and arcuately in response to the movement of the transfer gear 65, the hook 69 engages post 66 and causes it to move along a path which extends between the front and rear of the dispenser. As a result, the transfer fingers 52 begin to move in the direction of the nip 47. After the transfer gear 65 has been rotated, the amount of rotation can vary depending on the location of fingers 52 relative to nip 47, the transfer bar 51 is positioned in front of nip 47 so that the transfer fingers 52 contact the web 27 and position it within the nip 47 as the transfer gear 65 continues to rotate along its toothed portion. Pressure between the fingers 52 and the rollers 22, 24 can stop the transfer gear 65 from rotating.

As seen in FIG. 4, the bottom of the hook 69 is open and the front, inner edge 80 of the hook 69 is beveled so that the post 66 can move in and out of the hook 69 depending on the position of the front cover 20, the transfer bar 51 and the transfer link 63. The edge 80 includes an upper, pointed portion 86 for engaging the rod 66 when the transfer link 63 moves toward the rear of the dispenser 10 in response to the rotation of transfer gear 65. When the cover 20 is opened, the post 66 falls out of the hook 69 through the open bottom and the transfer bar 51 rotates downwardly, as discussed below. As the cover 20 is closed, the post 66 moves into the open, lower side of hook 69 by passing along the beveled edge 80. The inner, open area 81 of the hook 69 is also larger than the diameter of the post 66 so that the post 66 has adequate clearance to drop out of the hook 69 and away from the transfer link 63 when the cover is opened and return into the hook 69 as the cover is closed. The inside of hook 69 proximate the transfer link 63 includes a recessed portion 88 for receiving post 66 and returning it with transfer bar 51 to their rest positions. It is also contemplated that the transfer mechanism can operate with a dispenser which has a cover that pivots to its open position along a top edge. In such a dispenser, the transfer system 50 would be appropriately located within the chassis 12.

The transfer mechanism 50 can also include a return mechanism for returning the transfer bar 51 to its rest position. In a preferred embodiment, this mechanism comprises spring retaining member 84 which secures a first end of a coil spring 85 or other type of resilient or gear return member to the transfer gear 65. The second end of the coil spring 85 is secured to the chassis 12 or another part of the dispenser. The transfer gear 65 could also include a pair of spring retaining members 84 and a pair of coil springs 85, each attached to one of the retaining members 84. When the transfer bar 51 is at rest, the coil spring(s) 85 is also at rest. However, when the transfer gear 65 rotates in response to the movement of gear 62, the coil spring 85 is extended, the transfer link 63 moves toward the rear of the dispenser and the transfer bar 51 rotates in the direction of the nip 47. After the web 27 has been transferred to the nip 47, the coil spring 85 returns to its rest state while returning the transfer gear 63 to its rest position—the same position it was in before the transfer motor 61 was activated. During this return stroke, the recessed portion 88 engages post 66 and returns it and transfer bar 51 to their rest positions. When such a return mechanism is used with transfer gear 65, the output shaft of the transfer motor 61 free wheels in its reverse direction.

In another preferred embodiment, the return mechanism can include a reverse drive mechanism of motor 61. This reverse drive mechanism powers the transfer bar 51, the transfer link 63 and the transfer gear 65 to their rest positions after the web 27 has been introduced and fed through the nip 47. In this embodiment, the coil springs 85 are not needed because the motor 61 performs their operation. However, they may be used to assist the motor 61 when operating in its reverse direction, thereby reducing the amount of power consumed by the reverse drive mechanism.

The transfer system 50 eliminates the need for an attendant to go through the complicated process of feeding or threading the web 27 into the nip 47. The operation of this dispenser 10 will be described with reference to a paper web, however, other dispensable webs could be used. When a dispenser according to the present invention is new or is otherwise without paper, the attendant must open the front cover 20 and load at least one paper towel roll. If the dispenser is designed to accommodate a primary roll and a reserve roll, the attendant will normally load both rolls within the dispenser while the cover 20 is open. When loading the paper, the attendant unlocks the dispenser and rotates the cover downwardly away from the chassis 12 to its web loading position as shown in FIG. 2. However, as discussed above, the cover 20 can also be rotated in an upward direction. As the cover 20 is opened and pivoted to its web loading position, it will no longer abut and support the transfer bar 51 in its rest position as shown in FIG. 1. As a result, the bar 66 falls out of hook 69 and the transfer bar 51 pivots about shaft 70 and rotates downwardly away from the rollers 22, 24 along the same or a similar path as the cover 20. This causes both the cover 20 and the transfer bar 51 to assume their web loading positions where they will not interfere with the attendant installing the paper towel rolls in the dispenser. As discussed above, it is possible for the transfer bar 51 to experience both translational and rotational motion before reaching web loading position shown in FIG. 2.

After loading the primary roll, the attendant can either feed the leading edge of the primary roll into the nip 47 or position the leading edge of the web 27 in front of the nip 47. In a preferred embodiment, the attendant positions the leading edge in a cradle 91 located in front of the nip 47. After positioning the web 27 in front of the nip 47, the attendant will close the cover 20 by rotating it upward toward the chassis 12. As the cover is rotated upward, the inner surface of cover 20 contacts the cover engaging members 53 on the transfer bar 51, supports transfer bar 51 and rotates the transfer bar 51 toward the chassis 12. As the cover is being closed, the post 66 moves upwardly into hook 69. When the cover 20 is closed, the transfer bar 51 will be located in its rest position and the finger 52 will be aligned and extending in the direction of the nip 47, as shown in FIGS. 1 and 3.

As the cover 20 is closed, a switch (not shown) may be engaged to activate the sensor 28 which detects the presence or absence of a leading edge of the paper web 27 on the discharge side of the feed mechanism 37. When the absence of a web 27 is detected by the sensor 28, the transfer system 60 and feed mechanism 37 are activated. Motor 61 drives the output gear 62 in a counter clockwise direction (as shown in FIG. 4). The rotating output gear 62 drives the transfer gear 65 in a clockwise direction (as shown in FIG. 4). This results in the transfer link 63 moving toward the rear of the chassis 12. As the transfer link moves, hook 69 engages rod 66 and imparts the movement of the link 63 to rod 66. As rod 66 is pulled toward the rear of the chassis 12, the transfer bar 51 pivots toward the rear of the chassis 12 about shaft 70. Fingers 52 move in the direction of the web 27 and engage the portions of the web 27 hanging in front of the nip 47. The fingers 52 rotate until they abut against the driven feed roller 22 and the pressure roller 24. As this occurs, the web is introduced into the nip 47 and taken up by the feeding mechanism 37. When the presence of the web 27 is sensed on the discharge side of the feed mechanism 37, the motor 61 is stopped. The return mechanism then causes the transfer mechanism 50 and the transfer bar 51 to return to their rest positions. As discussed above, this can be accomplished by using one or more coil springs or a motor 61 with a reverse drive mechanism that rotates the output gear 62 and the transfer gear 65 in the reverse direction so that transfer link 63 moves towards the closed cover 20, thereby causing hook 69 to return the post 66 and the transfer bar 51 to their rest positions. The transfer mechanism 50 and transfer bar 51 can be activated when the cover 20 is closed by a switch located on the exterior of the dispenser. The use of a switch permits the transfer mechanism to be operated without the cover being opened and closed. When a dispenser includes supports for both a primary and a reserve roll of the web 27, the leading edge of the reserve roll is positioned in front of the nip 47 and possibly in the cradle after the leading edge of the primary web 27 has been transferred to the feeding mechanism. When the trailing edge of the primary roll is sensed, the transfer mechanism 50 is activated for introduction of the reserve roll. This introduction is accomplished in the same manner as discussed above with respect to the introduction and feeding of the primary roll. The fingers 52 position the reserve web in the nip 47 without the cover being opened so that the reserve web is introduced into and picked up by the feeding mechanism 37 and dispensed to the user. This creates a smooth, almost instantaneous transition between the primary and reserve rolls loaded within the dispenser 10.

Numerous characteristics, advantages and embodiments of the invention have been described in detail in the foregoing description with reference to the accompanying drawings. However, the disclosure is illustrative only and the invention is not limited to the illustrated embodiments. Various changes and modifications may be effected therein by one skilled in the art without departing from the scope or spirit of the invention.

We claim:

1. An apparatus for dispensing a flexible web, said apparatus comprising:

a chassis including a web discharge opening;

a feed mechanism for advancing first and second webs to the web discharge opening;

a sensor for determining when the first web is absent from a side of the feed mechanism; and an automatic web transfer mechanism including a web transfer member for engaging the second web and a motor for driving said transfer member in response to a signal of said sensor from a rest position where said web transfer member is spaced from said feed mechanism to a web feed position where said web transfer member is in contact with the second web and positions the second web in a feed nip of the feed mechanism.

2. The apparatus according to claim 1 wherein said transfer member includes a transfer bar having a plurality of web engaging members for introducing the second web into said feed mechanism.

3. The apparatus according to claim 2 wherein said transfer bar is pivotally connected to the chassis for rotating relative thereto.

4. The apparatus according to claim 2 further comprising a transfer bar retraction mechanism for returning the transfer bar to the rest position after the second web has been sensed proximate the discharge opening.

5. The apparatus according to claim 2 wherein said transfer mechanism further comprises a drive gear secured to an output drive shaft of said motor.

6. The apparatus according to claim 2 wherein said transfer bar includes a plurality of transfer fingers for engaging the second web and advancing said second web toward the feeding mechanism.

7. The apparatus according to claim 2 wherein said transfer mechanism further comprises a transfer gear and a transfer link extending between said transfer gear and said transfer bar.

8. The apparatus according to claim 7 wherein said transfer bar is pivotally connected to said chassis.

9. The apparatus according to claim 8 wherein said chassis includes a front cover which supports said transfer bar when said transfer bar is in the rest position.

10. The apparatus according to claim 8 wherein said transfer link includes an open transfer bar engaging hook which permits said transfer bar to rotate away from said chassis.

11. The apparatus according to claim 1 wherein said sensor includes a photo sensor for sensing the absence of the first web and activating the web transfer mechanism.

12. The apparatus according to claim 1 wherein said sensor is positioned along a web discharge path between said feed mechanism and said web discharge opening for determining the absence of the first web on a discharge side of the feed mechanism.

13. A web dispenser comprising:

a chassis including a web discharge opening;

a feed mechanism for advancing first and second webs to the web discharge opening;

a photo sensor for determining when the first web is absent from a side of the feed mechanism; and an automatic web transfer mechanism including a web transfer member for introducing the second web into said feed mechanism, wherein said web transfer mechanism moves from a rest position where said web transfer member is spaced from said feed mechanism to a web feed position where said web transfer member is in contact with the second web and positions the second web in a feed nip of said feed mechanism for feeding the second web when the absence of the first web is sensed within the dispenser.

14. The web dispenser according to claim 13 further comprising a motor for driving said transfer member from said rest position toward said feed mechanism.

15. The web dispenser according to claim 13 wherein said transfer member includes a transfer bar having a plurality of web engaging members for contacting the second web and positioning the second web in said feed mechanism.

16. The web dispenser according to claim 15 wherein said transfer bar is pivotally connected to the chassis for rotating relative thereto.

17. The web dispenser according to claim 15 further comprising a transfer bar retraction mechanism for returning the transfer bar to the rest position after the second web has been sensed proximate the web discharge opening.

18. The web dispenser of claim 13 wherein said sensor is positioned along a web discharge path between said feed mechanism and said web discharge opening for determining the absence of the first web on a discharge side of the feed mechanism.

19. The web dispenser of claim 13 wherein said transfer mechanism further includes a motor that operates in response to a web absence signal from said sensor, wherein said motor causes said transfer member to move from said rest position to said web feed position.

20. A web dispenser comprising:

a chassis including a web discharge opening;

a feed mechanism for advancing first and second webs to the web discharge opening;

a sensor for determining when a leading edge of the first web is absent from a discharge side of the feed mechanism;

an automatic web transfer mechanism including a web transfer member for moving from a rest position where said web transfer member is spaced from said feed mechanism to a web feed position where the web transfer member is in contact with the second web for introducing the second web into a nip of the feed mechanism; and a retraction mechanism for returning said transfer member to the rest position after the second web has been introduced to said feed mechanism.

21. The dispenser according to claim 20 wherein said retraction mechanism comprises at least one spring biased member secured to said transfer mechanism.

22. The dispenser according to claim 20 wherein said transfer mechanism includes a transfer gear operatively connected to said transfer member and a motor for driving said transfer gear such that said transfer member moves from the rest position toward said feed mechanism; and wherein said retraction mechanism includes a spring having a first end secured to said transfer gear.

23. The dispenser according to claim 20 wherein said transfer mechanism includes a motor for driving said transfer member toward said feed mechanism, and said retraction mechanism comprises a reverse drive portion of said motor.

24. The dispenser according to claim 20 wherein said transfer member includes a transfer bar having a plurality of web engaging members for introducing the second web into said feed mechanism.

25. The dispenser according to claim 24 wherein said transfer bar is pivotally connected to the chassis for rotating relative thereto.

26. The dispenser according to claim 20 wherein said sensor is a photo sensor.

27. The dispenser of claim 20 wherein said sensor is positioned along a web discharge path between said feed mechanism and said web discharge opening for determining the absence of the first web on the discharge side of the feed mechanism.

28. The dispenser of claim 20 wherein said transfer mechanism further includes a motor that operates in response to a web absence signal from said sensor, wherein said motor causes said transfer member to move from said rest position to said web feed position.

29. A method of positioning a web in a feed mechanism of a dispenser, said method comprising the steps of:

a) positioning a leading edge of at least one of a first and a second web proximate a first side of the feed mechanism;

b) sensing the absence of the first web on a second side of said feed mechanism;

c) activating a powered transfer drive mechanism;

d) automatically advancing a transfer bar from a rest position, where said transfer bar is spaced from said feed mechanism, toward the feed mechanism after the absence of the first web has been sensed;

e) engaging said second web with said transfer bar; and f) advancing the second web into said feed mechanism.

30. The method according to claim 29 further including the steps of:

a) opening a cover of the dispenser;

b) moving the transfer bar away from the feed mechanism to an open cover position; and c) loading at least one of the first and second webs into the dispenser.

31. The method according to claim 30 wherein said at least one of said first and second webs is loaded into the dispenser before the leading edge is positioned proximate the feed mechanism.

32. The method according to claim 30 further including the step of moving the transfer bar from the open cover position to the rest position by closing the cover of the dispenser.

33. The method according to claim 29 wherein the step of automatically advancing the transfer bar includes rotating the transfer bar from said rest position to a web engaging position.

34. The method according to claim 33 further including the step of automatically returning the transfer bar from the web engaging position to the rest position after the second web has been sensed on the second side of said feed mechanism.

35. The method of claim 29 wherein said engaging step includes engaging said second web with a plurality of positioning members extending from said transfer bar in the direction of the feed mechanism.

36. A dispenser for dispensing a flexible sheet material, said dispenser comprising:

a chassis including a web discharge opening;

a feed mechanism for advancing first and second webs to the web discharge opening;

a sensor for detecting an absence of the first web from a discharge side of the feed mechanism; and an automatic web transfer mechanism for introducing the second web into said feed mechanism, said web transfer mechanism including a web transfer member and a motor, wherein when the absence of the first web is sensed within the dispenser said motor is operated and said web transfer member moves from a rest position where said web transfer member is spaced from said feed mechanism to a web feeding position proximate said feed mechanism for positioning a portion of the second web proximate the feed mechanism.

37. The dispenser of claim 36 wherein said motor drives said web transfer member from said rest position to said web feeding position.

38. The dispenser of claim 36 wherein said feed mechanism includes a feed nip for receiving the portion of the second web.

* * * * *

UNITED STATES PATENT AND TRADEMARK OFFICE

CERTIFICATE OF CORRECTION

PATENT NO. : 6,736,348 B1
DATED : May 18, 2004
INVENTOR(S) : Formon et al.

It is certified that error appears in the above-identified patent and that said Letters Patent is hereby corrected as shown below:

Title page,
Item [*] Notice, delete the phrase "by 356" and insert -- by 371 days --

Signed and Sealed this

Nineteenth Day of April, 2005

JON W. DUDAS
*Director of the United States Patent and Trademark Office*